US009791127B2

(12) United States Patent
Langhart

(10) Patent No.: US 9,791,127 B2
(45) Date of Patent: Oct. 17, 2017

(54) LIGHTING APPARATUS WITH ANNULAR SEGMENTED REFLECTOR

(71) Applicant: Christopher Langhart, New Hope, PA (US)

(72) Inventor: Christopher Langhart, New Hope, PA (US)

( * ) Notice: Subject to any disclaimer, the term of this patent is extended or adjusted under 35 U.S.C. 154(b) by 239 days.

(21) Appl. No.: 14/245,857

(22) Filed: Apr. 4, 2014

(65) Prior Publication Data

US 2015/0285460 A1 Oct. 8, 2015

(51) Int. Cl.

| | |
|---|---|
| ***F21V 7/00*** | (2006.01) |
| ***F21V 7/04*** | (2006.01) |
| *F21W 131/406* | (2006.01) |
| *F21V 11/18* | (2006.01) |
| *F21V 7/22* | (2006.01) |
| *F21V 9/08* | (2006.01) |
| *F21V 14/08* | (2006.01) |
| *F21V 21/08* | (2006.01) |
| *F21V 21/30* | (2006.01) |
| *F21V 29/67* | (2015.01) |

(52) U.S. Cl.

CPC ..... *F21V 7/0025* (2013.01); *F21V 7/041* (2013.01); *F21V 7/04* (2013.01); *F21V 7/22* (2013.01); *F21V 9/08* (2013.01); *F21V 11/183* (2013.01); *F21V 14/08* (2013.01); *F21V 21/08* (2013.01); *F21V 21/30* (2013.01); *F21V 29/67* (2015.01); *F21W 2131/406* (2013.01)

(58) Field of Classification Search

CPC ..... F21V 7/0025; F21V 7/041

See application file for complete search history.

(56) References Cited

U.S. PATENT DOCUMENTS

| | | | | |
|---|---|---|---|---|
| 2008/0192477 | A1* | 8/2008 | Holder | F21S 48/328 362/294 |
| 2012/0069562 | A1* | 3/2012 | Singer | F21V 7/0025 362/231 |
| 2014/0103796 | A1* | 4/2014 | Jansen | F21V 7/041 313/498 |

* cited by examiner

*Primary Examiner* — Mary Ellen Bowman

(74) *Attorney, Agent, or Firm* — IP Works, PLLC; Wayne Carroll

(57) ABSTRACT

The present invention is directed to an apparatus for providing a light reflector, light fixture, light fixture retrofit apparatus, lamp reflector, lamp retrofit apparatus or luminaire reflector retrofit. According to an example embodiment of the disclosed invention, a light reflector is provided that includes annular segments nested as cone-shaped layers configured for reflecting light from a light source placed in proximity to the inner cone portion. The two or more nested cone-shaped annular segments include a reflective surface. The cone-shaped annular segments are configured such that the segment layer having the smallest aperture is located farthest from the light source.

11 Claims, 9 Drawing Sheets

LIGHTING APPARATUS WITH ANNULAR SEGMENTED REFLECTOR

STATEMENT REGARDING FEDERALLY SPONSORED RESEARCH OR DEVELOPMENT

The present invention was not developed with the use of any Federal Funds, but was developed independently by the inventor.

CROSS-REFERENCE TO RELATED PATENTS AND APPLICATIONS

This application does not claim the benefit of any prior applications.

FIELD OF THE INVENTION

The disclosed invention relates generally to lighting apparatus or luminaires, and particularly to light reflectors, and more particularly to a light reflector assembly for stage lighting.

BACKGROUND

Stage lighting luminaires, often called instruments in the lighting profession, and are used for lighting performance centers, stages, multifunctional halls, exhibition halls, restaurants, bars and other indoor and outdoor venues where performance, music and pageantry take place or where it is desirable to place lighting on an object or scene.

Typical stage lighting involves lights having a directional beam with a light source that is directed onto the stage in order to provide lighting for the performance. Conventional fixed and moving head lights and down-lights are also used. When light sources, such as compact fluorescent lamps or LEDs (light emitting diodes) with broad distribution patterns are used in down-lights, luminaire efficiency tends to be relatively low, with an average efficiency typically less than 60%, which may be due to light losses within the lighting apparatus. The possible range of sizes and shapes of reflector design are typically limited by the geometry of the housing, lamp placement, and the luminaire's light distribution considerations. A large percentage of light emitted from the light source may become trapped/absorbed within the fixture housing and may be significantly attenuated by multiple reflections before exiting the luminaire.

Theatrical lights or instruments typically have ellipsoidal reflectors and lenses, spherical reflectors and lenses or parabolic reflectors with or without a lens. These instruments, sometimes also called lanterns (UK), have various features including framing shutters, adjustable beam width, and soft edged or more defined beam edges. In the last 15 years or so, "moving lights" have also been introduced more widely for music performance and theatrical use, some of which may include remote control of color, beam-width, pan, tilt, flashing, intensity and various 'gobo' patterns that allow variation in beam pattern and shape. The gobo patterns may also be rotated by remote control.

Parabolic reflectors, when used in accent lighting, generally narrow the beam so as to concentrate the light on a particular area of interest to be illuminated as in an isolated museum display. The effectiveness which a reflector has at concentrating the light beam in a specific direction is related to the size of the luminous source and the distance between the source and the reflector and its shape.

The effectiveness or efficiency of any given luminaire is governed mainly by two factors. The first factor is related to the intrinsic efficiency of the light source, which is related in lumens per watt, meaning the number of watts of power that it takes to produce a certain number of lumens of light. The second factor is dependent upon the desired output beam pattern of the fixture in question.

Parabolic Aluminized Reflector lights, or PAR lights, or PAR cans, are used when a substantial amount of lighting is required for a scene. A PAR can is a sealed beam PAR lamp housed in a simple can-like unit. The reflector is integral to the lamp and the beam spread of the unit is not adjustable except by changing the lamp. PAR lamps are widely used in architectural lighting. PAR lights have seen heavy use in rock and roll shows, especially those with smaller budgets, due to their low cost, light weight, easy maintenance, high durability, and high output. They are often used in combination with smoke or haze machines which make the path of the beam visible. They are also often used as top, back, or side lights in the theater and for special effects. All PAR lamps except those with narrow or very narrow lenses produce an intense oval pool of light, some with fixed focus and soft edges. In order to adjust the orientation of the oval, the lamp must be rotated.

Scoop lights or scoops are circular fixtures that do not have any lenses. They have an ellipsoidal reflector at the back of the fixture that directs the light out of the fixture. Since they do not have any sort of lens system they are cheaper than other fixtures. However, the light cannot be focused at all. Scoops are most often used to flood the stage with light from above, or to light backdrops and are occasionally used as work lights.

LED stage lights are stage lighting instruments that use light-emitting diodes (LEDs) as a light source. LED instruments are an alternative to traditional stage lighting instruments which use a halogen lamp or high-intensity discharge lamps. Like other LED instruments, they have high light output with lower power consumption. Most LED fixtures utilize three or more colors (usually red, green, and blue) which can be mixed to hypothetically create any color. LED stage lights come in four main types—PAR cans, spotlights, strip lights, and moving head lights. In LED PAR cans, a round printed circuit board with LEDs mounted on is used in place of a PAR lamp. Moving head types can either be a bank of LEDs mounted on a yoke or more conventional moving head lights with the bulb replaced with an LED bank. Most shows use LEDs only for lighting cycloramas, or as top, side, or back light due to their low throw distance. They can also be used as audience blinders (lights pointed directly at the audience from a low angle). Phosphorescent coatings over LED lights can result in light having wavelengths other than those output by the LED.

The ellipsoidal reflector spotlight (ERS), also known as a profile spot (after its ability to project the silhouette or profile of anything put in the gate) (UK) and Découpe (French), is the most abundant instrument type currently in theatrical use. These are sometimes known as a profile spotlight (in Europe) or by their brand names, especially the Source Four (a popular lantern from ETC) and the Leko (short for Lekolite, from Strand lighting). The major components of an ERS light are the casing in which the internal parts are mounted, an ellipsoidal reflector located in the back of the casing, a lamp mounted to position the filament at the rear focal point of the ellipsoid, a dual plano-convex lens (two plano-convex lenses facing each other in the barrel), and at the front, a gel frame to hold the color gel. The light from the lamp is efficiently gathered by the ellipsoidal reflector and sent forward through the gate, shutters and lens system.

Fresnel lantern (UK), or simply Fresnel (US), employs a Fresnel lens to wash light over an area of the stage. The distinctive lens has a 'stepped' appearance instead of the 'full' or 'smooth' appearance of plano-convex lens used in other lanterns. The resulting beam of light is wide and soft-edged, creating soft shadows, and is commonly used for back light, top light, and side light. Another method of controlling the spread of light is to use either a top hat (also referred to as a snoot), which generally limits the light coming out, or a barn door, whose flaps work as though they were shutters on an ERS. These methods limit light output and keep excess light from spilling into the eyes of audience members or where it is not desired. Fresnels use a spherical reflector, with the lamp at the focus point. The lamp and reflector remain a fixed unit inside the housing, and are moved forward and back to focus the light. This is accomplished using a slider on the bottom or side of the lantern, or using a worm track. At very tight focus, the lanterns are the least efficient, as the least light can escape the housing. Therefore Fresnels are not good for tight focus on small areas. They are most often used at medium distances from the stage for area lighting.

The "Source Four Par" (US) is a lighting instrument which combined the design of the PAR fixture with that of the Fresnel. The fixture is more versatile, allowing for a flood or a softer spot. Pebble Convex lanterns are similar to Fresnels, but use a plano-convex lens with a pebbled effect on the planar (flat) side, resulting in less "spill" outside the main beam. They are currently used much more widely in Europe than North America.

A beam projector is a lens-free instrument having very little beam spread. It often uses two reflectors. The primary reflector is a parabolic reflector and the secondary reflector (often omitted) is a spherical reflector. The parabolic reflector directs the light into nearly parallel beams, and the spherical reflector is placed in front of the lamp to reflect light from the lamp back to the parabolic reflector, which reduces spill. The result is an intense shaft of light that cannot be easily controlled or modified. Newer fixtures and PAR lamps have created easier ways to produce this effect. One example of a beam pattern is a conventional sealed beam car headlight where most of the light beams are directed down and out to the road but some light beams escape directly from the light source forward unless partially masked in a wide-angle direction not under the control of the reflector.

Another example is the stage lighting spotlight or followspot (also in architecture called a trackspot, or limelight). The followspot is a lighting instrument that is moved during a performance by an operator or control to provide emphasis or extra illumination and usually to follow a specific performer when he or she is moving around the stage. Followspots contain a variety of operator-controlled optical mechanisms. They may include mechanical shutters, which allow the light to be doused without turning off the lamp, lenses to control and focus beam width, and internal color gels, often in a color magazine. The followspot projects a circle of light onto a performer on a stage from the rear of the hall with very little light spilling beyond the specific area surrounding the performer. The light from the source is either directed by reflectors and or lenses to the area to be illuminated, whatever its size and shape designed, or less desirably, the light from the source is shaded, that is, the light is absorbed or blocked, such that the light cannot escape from the luminaire in an undesirable direction. Followspots are commonly used in musical theater and opera to highlight the stars of a performance, but may be used in dramas well. They are also used in ice rinks and sports venues. In stadiums, sports-lighters with a large reflector and metal halide lamp are considered appropriate for general lighting when used with other similar fixtures on a sports field for sporting or other events. These lighting instruments come in a variety of sizes with light sources ranging from low power incandescent light bulbs to very powerful Metal Hallide arc lamps. Carbon arc lamp spots were common until the 1980s, using the arc between carbon rods as their light source. These followspots require special installations that includes high volume ventilation due to the hazardous Ozone fumes produced by the carbon arc. The hot discharge in xenon arcs creates extremely high internal pressure in the lamp and thus presents a safety concern.

Hydrargyrum medium-arc iodide lamps, designed initially for use in film, are now seen commonly on stage. These instruments produce light with a color temperature similar to daylight (5600K to 6000K). HMI fresnels are most common, but HMI PARs are also available.

These instruments typically require a large amount of power (between 2 kW and 12 kW) and must be dimmed mechanically or with the use of an electronically controlled douser.

Lighting fixtures are also used in architecture. Architectural lighting falls into three broad categories—general lighting, task lighting and accent lighting. The size of the area to be illuminated and the distance between the area to be illuminated and the fixture location or position determine the lighting fixture chosen by the designer. For example, fluorescent lighting may be considered appropriate in a library.

The luminaire system according to the present invention addresses many of the disadvantages of the prior art. The lighting instrument of the invention provides greater control and efficiency than attainable with existing lighting instruments for lighting designed principally to provide near parallel beams for illuminating a specific area from a significant distance. The reflector of the invention allows the source of light to be surrounded more completely than possible with current lighting instruments. This new reflector system redirects more of the source illumination into nearly parallel beams irrespective of the intrinsic luminous efficiency of any light source chosen to be used within the reflector system. Significant distances of greater than 20 times the diameter of the luminaire are possible. The system of reflectors in this invention also allows the beam width to be varied without encountering the increasing absence of light in the center of the beam as compared to conventional parabolic reflectors when the light source is moved. It has been found that 30% to 40% more illumination is achieved by redirecting the luminous output from the light source in accordance with the use of the invention herein.

One embodiment of the apparatus provides a collapsible reflector. An advantage of the collapsible embodiment of the invention includes ease of transport, shipment, and storage rendering it especially useful for traveling performances. Other advantages of the reflector system of the invention will be readily apparent to persons skilled in the art.

SUMMARY

Provided is a light reflector system composed of two or more reflective surfaced annular rings or segments nested so as to direct light from a luminous point source into nearly parallel beams. More specifically, provided is a lighting apparatus having a reflector comprised of two or more nested annular segmented rings having a reflective surface and arranged in cone-shaped layers configured to reflect light from a light source placed in a housing within the inside of the reflector. The two or more nested annular rings include a reflective surface disposed on the inner surface of the annular segments. According to one embodiment, the annular rings are further comprised of facets that enable the movement or adjustment of each annular ring so as to control the amount of light by varying the angle of the reflective surface. According to one embodiment of the reflector, the annular segments are manually adjustable. According to another embodiment, the annular segments are electronically adjustable. According to one embodiment of the invention, the lighting apparatus is collapsible.

DRAWINGS

The invention herein will be more fully understood in conjunction and reference to the following drawings. Preferred and alternative embodiments of the present invention are described in detail below.

DETAILED DESCRIPTION OF THE INVENTION

Figure 1:
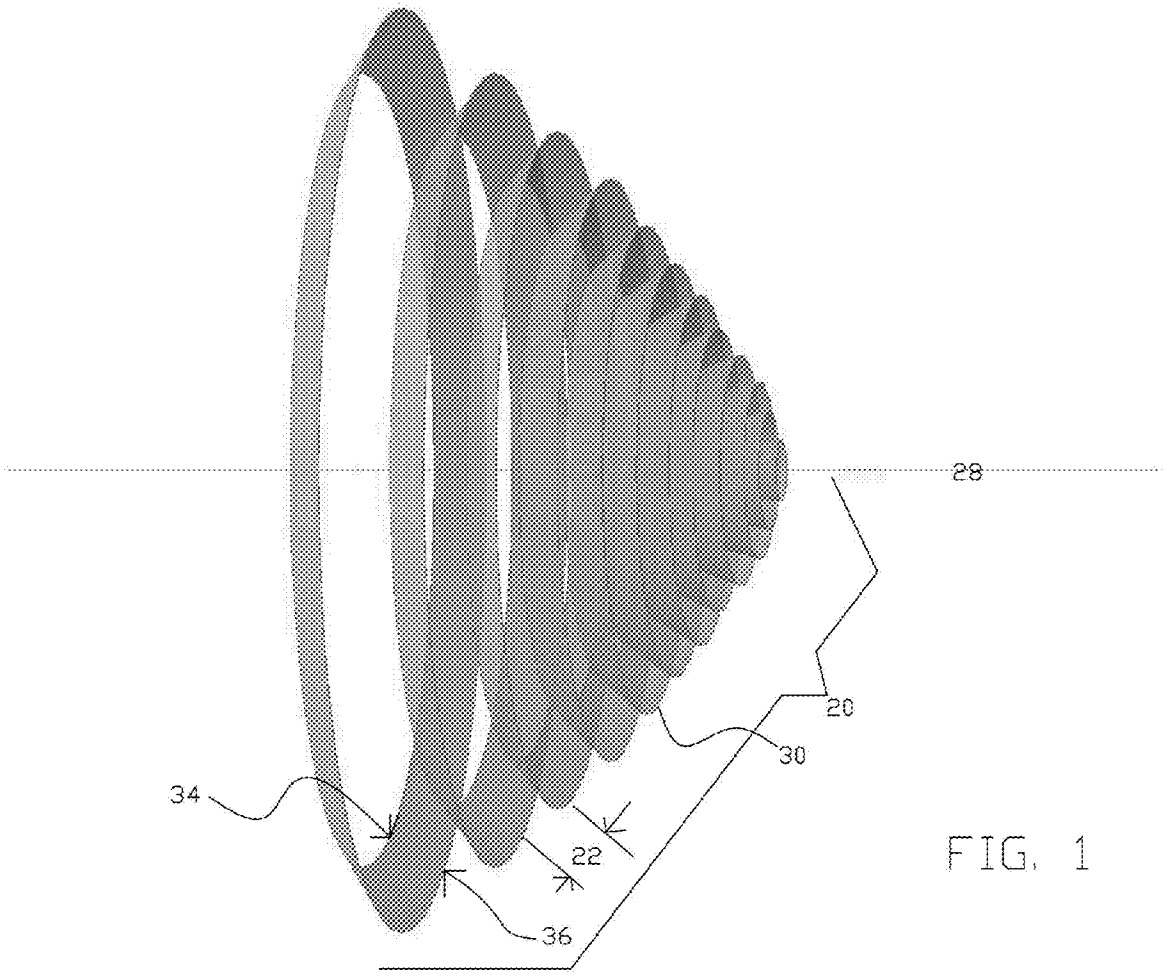
FIG. 1 is a perspective view of the segmented annular ring reflector apparatus of the invention.

The term "light emitting element" as used herein, means any light source, lamp, light bulb, such as, but not limited to incandescent bulbs, halogen bulbs, light emitting diodes (LED), arc lamps, fluorescent bulbs, gas discharge lamps, light emitting material or other element that provides light. Most theatrical lamps are tungsten-halogen (or quartz-halogen), an improvement on the original incandescent design that used halogen gas instead of an inert gas. Fluorescent lights are rarely used other than as work lights. Although they are more efficient, they cannot be dimmed without using specialized dimmers, cannot dim to very low levels, do not produce light from a single point or easily concentrated area, and have a warm-up period during which they emit no light or do so intermittently. High-intensity discharge lamps (HID lamps) are common where a very bright light output is required, for example in large followspots, HMI (hydrargyrum medium-arc iodide) floods, and modern automated fixtures. LEDs are ideal where an intense but unfocused light source is required, such as for lighting a cyclorama. The light source of the invention will be limited only by choice in the desired light intensity or effect, or practically by the size of the reflector. The lighting element can be various colors and, in the case of LED's, can be the color of any available LED's. In some embodiments, a phosphorescent coating over the LED results in light having wavelengths other than those output by the LED. Light fixtures have a lighting element assembly that contains a housing with a light socket to hold the light bulb to allow for replacement of the light bulb when necessary. The electrical connection typically leads to a permanent power supply source though certain fixtures may contain battery powers of supply or solar cells. Permanent lighting may be directly wired, whereas moveable lamps will have a plug leading to the power source. Light fixtures may also include either a manual or an electrical panel for controlling the operation of the light.

In light reflectors used for stage lighting, certain variable factors are designed in order to direct the light onto the object. Such variable factors typically include the aperture of the reflector (with or without a lens), the depth of the reflector and the size of the outer shell, shade or reflector used for light alignment and protection. As used herein, the term "reflector" or "reflector apparatus" means the shell that is typically made a part of a light fixture that surrounds or is placed in close proximity to the light source and in some manner, shades, directs, reflects, converts, disperses or in any other way controls the light being emitted from the light source. The apparatus of the invention contains a reflector made of annular segments and is based on the concept that each annular segment is a frustum of a paraboloid with its focus at the light source. By defining a family of nested parabolas with appropriate bounds, the annular reflector segments can then be defined as surfaces of rotation about the central axis of the reflector assembly.

Light fixtures have a fixture body and a lighting element assembly that contains a housing with a light socket or electrical contacts to hold the light bulb and to allow removal and replacement of the light bulb when necessary. The electrical connection to the lamp socket or lamp support typically leads to a power supply source, which may be wired to a permanent power supply source or the light source may be energized by radio frequency energy.

Movable lighting luminaries may have disconnectable connections leading to the power source. Luminaries may also include a battery, solar cell or other source of power for operation of the light source and may include a switching panel or control panel for control and operation of various aspects of the apparatus. In light reflectors used for stage lighting, certain variable factors are designed in order to direct the light onto the object. Such variable factors typically include the aperture of the reflector (with or without a lens), the depth of the reflector and the size of the outer shell, shade or reflector used for light alignment and protection. In lighting instruments used for stage lighting, adjustable reflectors and lenses, gobos and shutters are used in order to direct modified light towards the object to be illuminated. Such adjustable factors include the variable position of the light source relative to the reflector lens or diffuser, adjustability of the reflector contour, and distance between several lenses and light source, or reflectors.

The apparatus of the invention contains a reflector made of annular segments and is based on the concept that each annular segment is a frustum of an elliptical paraboloid with its focus at the light source. By defining a family of nested parabolas with appropriate bounds, the annular reflector segments can then be defined as surfaces of rotation about the central axis of the reflector assembly.

The reflector of the invention has at least two annular segments of conical shape positioned around a light source. By conical is meant parabolic, ellipsoid, spherical, cone or other like shape or combination thereof. Particularly in the preferred embodiment of the reflector of this invention, segments of frustums or rings of a conical shape are positioned about a centerline which includes the position of the light source. Further, a family of reflectively surfaced annular nested frustums is arranged circularly about a light source so as to direct the Gaussian radiation of an approximate point source into adjustably, essentially parallel, rays. This allows the reflector to be positioned at significant distances from the object to be lit. [Distances as far as 20 times the diameter of the luminaire or more are possible.]

According to one embodiment, reflective segments of the annular rings may be manually adjustable of angle for deflecting the beam. According to another embodiment, the adjustability of the annular rings is motor actuated. The multiple annular rings of the reflector system of the present invention have the advantage of more completely surrounding and redirecting the luminous output of the light source than has been achievable with prior parabolic and semi-conical faceted reflectors.

Referring now to FIG. 1, the lighting apparatus 10 is shown. The lighting apparatus has a segmented reflector assembly 20 comprised of annular reflector segments 30.

Figure 2:
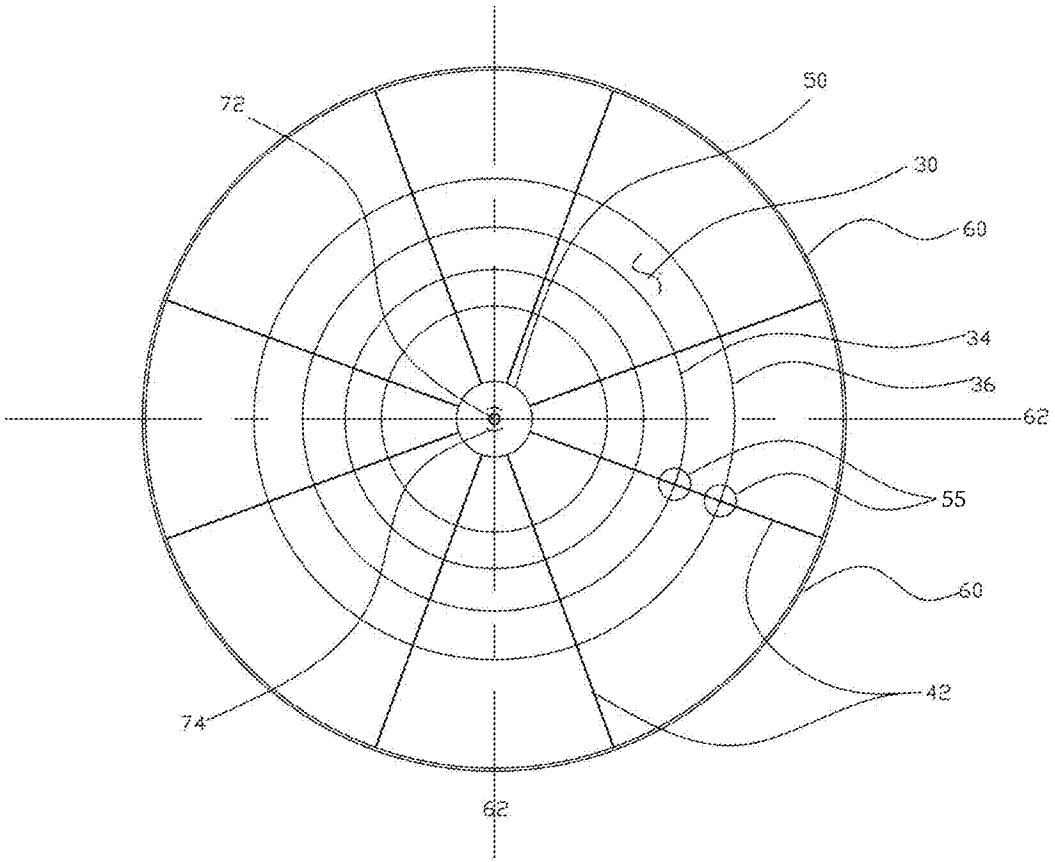
FIG. 2 is a front elevation view of radial reflector support arms of the invention.

Referring to FIG. 2 the reflector segments 30 are attached to one another by support unit 40 which has support arms 42, positioned as spokes that radiate from a support base 50. Each conical reflector segment 30 is connected to each support arm 42 by mechanical hinging means 59. Further support arms 42 collectively connect the annular reflective segments 30, to one another and collectively connect the reflector assembly to center tube 50, and exterior housing 60.

The distance between consecutive annular reflective segments 30 create respective openings 22 positioned within the reflector assembly 20. Each reflector segment has an interior portion or edge 34 and an exterior portion or edge 36. As illustrated in FIG. 2, both interior and exterior edges of each reflector segment are attached by the hinging means 59 to the support arms 42. Each reflector segment has an exterior edge 36 which is larger in circumference than its interior edge 34. As can be seen from the drawings, the reflector assembly forms a nested cone like structure. This unique and unexpected arrangement of reflector segments allows more complete surrounding of the light source for efficient control of redirected light rays. Any desired number of segments is operable according to the invention and the size of the reflector is limited only by practical considerations; such as the desired adjustability of the beam spread from wider to narrower, the overall size of the lighting instrument, the distance between the lighting instrument, the object to be illuminated and the size of the area to be illuminated.

The arms 42 can be fabricated from a durable material such as aluminum and steel or other metal, or plastic. In a preferred embodiment, eight support arms 42 are provided as illustrated in FIG. 2. In one embodiment, support arms 42 have hinging means 59 which attach to the interior and exterior portions of 34, 36 of each annular reflector segment 30.

The interior surface 31 of annular segments 30 are lined with a reflective surface. The annular reflector segments 30 also have an exterior surface 33. Typical reflective surfaces include mirror, glass sheet, aluminum, polished metal, metallic coatings, and high gloss paints though the invention is not limited to these reflective surfaces and any reflective surface is operable within the scope of the invention.

Figure 3:
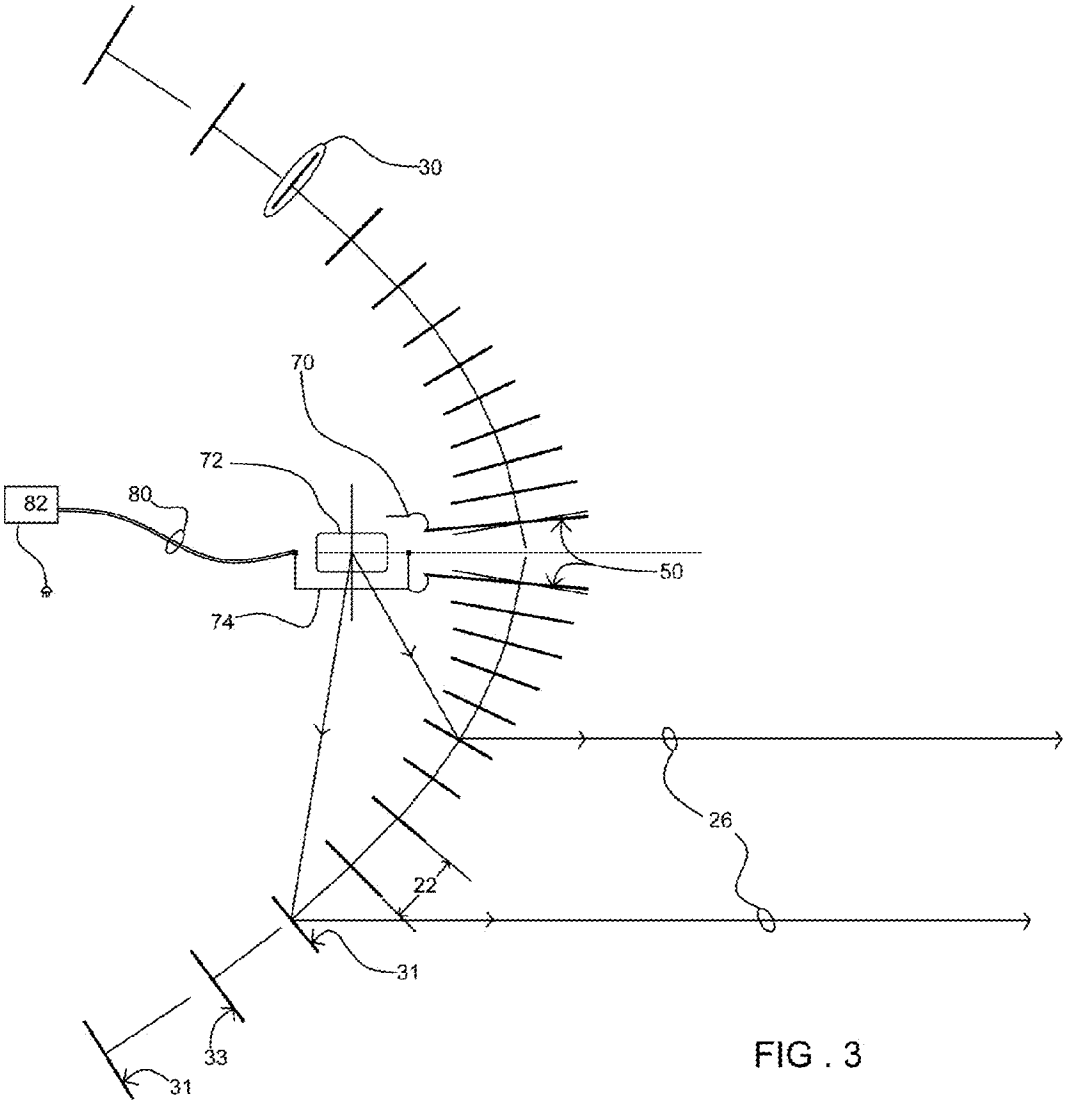
FIG. 3 is a sectional view of reflector and light source preferred embodiment showing the typical principal light ray reflection path.

Referring now to FIG. 3, the lighting apparatus of the invention comprises a lighting element assembly 70 for emitting light from a light source 72 that is positioned anywhere within reflector assembly 20 or outside and aligned in connection with the reflector assembly 20. Lighting element assembly 70 has a light socket 74 for connecting to light source 72. An electrical connection 80 leads the lighting element assembly socket 74 to a power supply 82, which is typically connected to an electrical outlet. In alternate embodiments, the power supply 82 can be in the form of a battery unit or a solar cell. A typical light beam/ray 26 is emitted from light source 72 is then reflected off of reflective surface 31, of annular ring reflector 30, through openings 22 in the reflector assembly 20 and onto the object to be illuminated.

One or both of the interior and exterior surfaces, 31 and 33 of the annular segments may be colored, textured, or treated to enhance its focusing, filtering or diffusing properties or to achieve a particularly desired lighting effect. For example, in one embodiment, the surfaces of some selected or all of the annular segments are partially abraded or partially covered by diffusing material to slightly soften or flood the direct radiation. In addition to reflective surfaces, the reflector assembly 20 can incorporate materials which will allow the partial or complete transmission of light through it in order to create a further desired lighting effect for example selectively separating radiated heat from radiated light. Such materials may include various types of glass plastic, mineral water, ceramic or dichroicly coated material, paper, nylon, or fabric. The material can further incorporate a waterproof or water-resistant element. Further, the reflector of the invention can be colored, textured, printed or embossed with a graphic design or otherwise treated. In one embodiment, the annular segments of the luminaire shade of the apparatus of the invention are made from a transparent or translucent material or wavelength selective reflective material or coated material.

FIG. 3 shows an embodiment of the lighting apparatus in cross-section view. As set forth above, the lighting apparatus 10 includes: the reflector assembly 20 annular segments 30, which have an interior surface 32 and a reflective exterior surface 33, an interior portion 34 and an exterior portion 36; interspersed between annular segments 30 are openings 22; the annular segments being mounted onto the support assembly 40 by being attached by way of hinging means 59 on the radial support arms 42 by attachment to the interior portion 34 and exterior portion 36 or annular segments 30. The reflector apparatus 20 houses a lighting element assembly 70 that contains a light source 72 that is connected by a light socket 74 through an electrical connection 80 to a power supply 82.

Figure 4:
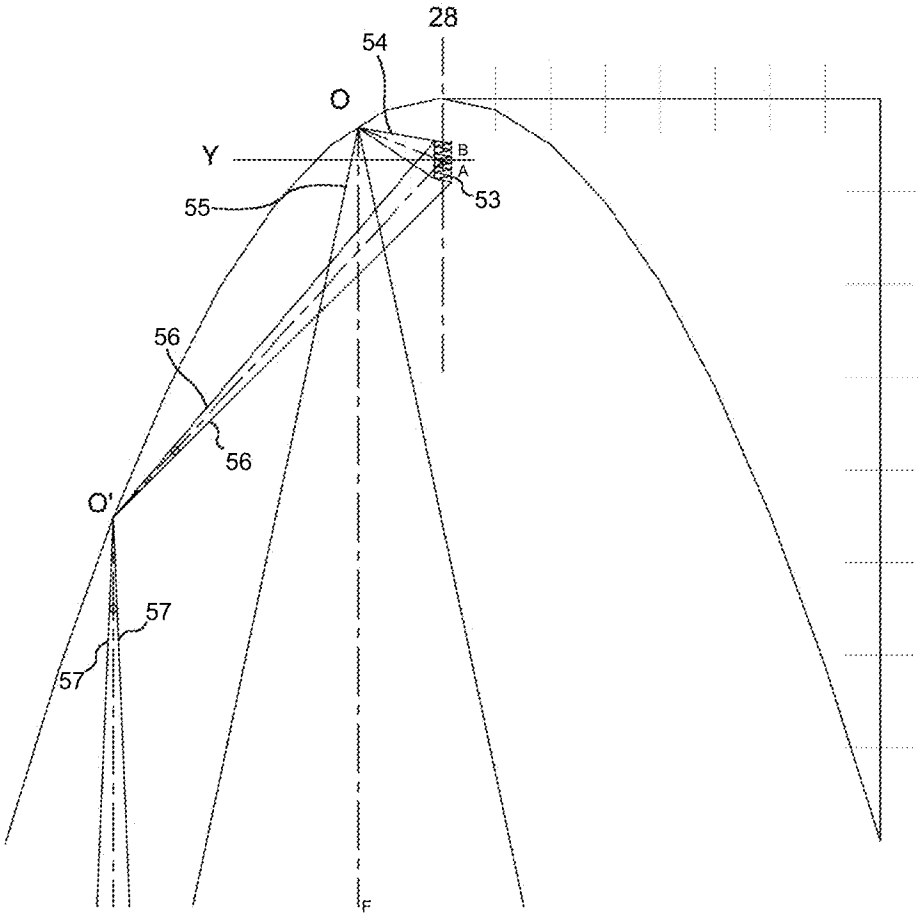
FIG. 4 illustrates the preferred annular ring reflector system embodiment from the classic parabolic reflector.

FIG. 4 graphically illustrates how the preferred reflector system of FIG. 1 redirects light beams in a way similar to the classic parabolic reflector shown, but with an output light beam having a smaller included angle and therefore desired, tighter narrower beam with a light source of the same size. The apparatus herein provides three additional advantages: [1] the entire reflector size may be smaller in diameter for given physical size of light source and narrowness of output light beam desired; [2] the reflector system can be designed to surround more of the light source and therefore increase efficiency of utilization over a classic parabolic reflector; and [3] the increased physical space around the area of the lamp allows for the physical positioning of the preferred color changing mechanism of FIG. 8 to be introduced without significantly sacrificing reflective surface area and thereby efficiency of the system.

FIG. 4 demonstrates further that the apparatus of the invention provides two opportunities for improving the narrow beam performance of a classic parabola like reflector system of the prior art. The reflector of the invention enables placement of the reflective surface farther from the light source than possible by current reflectors so that a narrower included angle for the reflection is achieved. In addition, the present invention allows increase of the effective depth of the reflector system so as to surround more of the light source and direct that radiation towards the object to be illuminated.

The additional advantage in breaking the classic reflector into annular reflective rings is that the rings may be positioned further behind as well as in front of the light source so as to surround it more completely thereby providing improved efficiency. Another advantage of the embodiment of FIG. 1 is that all reflecting surfaces are further from the light source than traditional light sources which also give off considerable heat. Therefore less damage will occur to the reflective surfaces from heat degradation.

In another embodiment of FIG. 1, utilizing the same improvements pointed out above over traditional parabolic reflectors, it would clear to those experienced in optical work that a totally encapsulated solution typically encompassing an LED, or solid-state laser source could have the improved reflector system described encapsulated into the same enclosure structure as the solid-state light source. Therefore, the "support assembly" of the reflector system will not require any support "arm" as described mechanically above because the encapsulation material supports both light source and the reflector system in a rigid relationship. This procedure is not unlike existing LEDs potted within traditional parabolic reflectors; see, for example, U.S. Pat. No. 7,230,280 to Yaw and Hwang, (incorporated herein by reference). Use of the improved reflector system of FIG. 1 in an encapsulated embodiment of the apparatus, does not preclude also using a lens or lens like contouring of the encapsulation material as additional means of beam control. Depending on the beam shaping desired and mechanical circumstances, some portions of the reflector system of this embodiment can be within the encapsulated enclosure along with the LED lights and that simultaneously other portions of the reflector system can be exterior to the encapsulated structure and positioned to be coordinated optically therewith.

Figure 7:
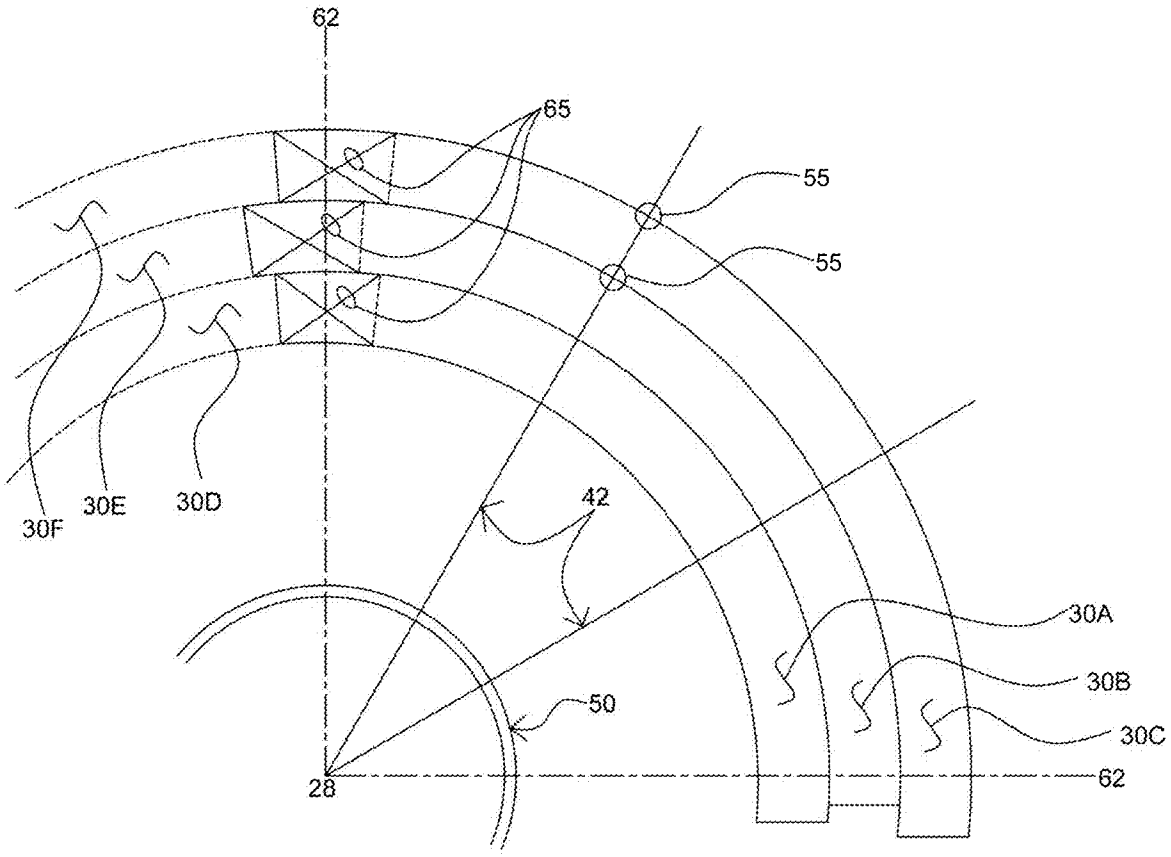
FIG. 7 shows a one quarter detail view of FIG. 2 limited by horizontal and vertical reference lines as shown in FIG. 2 and portions of three segmented annular rings of the invention.

According to another embodiment of the invention, the annular segments of the invention can be further comprised of facets or panels that are connected to one another. Referring again to FIG. 2, the horizontal and vertical indicating/dividing lines 62 divide the apparatus of FIG. 2 into four quadrants. One of these quadrants is enlarged in FIG. 7. FIG. 7 illustrates each annular reflector segment 30, divided into two, three, four or more segments or panels about the circumference of each annular segment 30. Introduction of panels permits adjustable angling of some portion or all of the annular segments 30 with respect to one another and the light source 72, as well as centerline 28. Conversely one continuous 360 degree circumference of the cone frustum of the annular segment or ring cannot change the angle with respect to the centerline of the cone without distortion of the cone shape. Segmenting or dividing the reflective annular rings 30, allows each quadrant of the reflector to be angled separately with respect to the light source 72, permitting angling of the light beams 26, exiting from light source 72 and reflecting off the interior surface 31 of the each annular segment 30. Although four equal sized panels are preferred in the faceted embodiment of the invention, any number of panels or facets are possible within the scope of the invention and the number is limited only by mechanical and manufacturing considerations.

FIG. 7 shows the faceted preferred embodiment illustrating the overlapping mechanism for annular segments 30 at the junction of the quadrants delineated by quadrant indicating lines 62. Three adjacent segments are shown from the top elevational view as facets 30A, 30B and 30G.

In an adjacent second quadrant of the reflector, annular segments of the same radius are labeled as facets 30D, 30E and 30F. Facets 30A, 30B, and 30C are configured to show their exterior edges 36 angled away from centerline 28 of the apparatus 20. Likewise, when facets 30D, 30E and 30F are also angled away from centerline 28, a gap is created between them where no reflective material is present. This is indicated on FIG. 7 at the location 65. One preferred embodiment of the reflector apparatus of the invention is structured so that each facet extends below its adjacent facet so as to provide an overlapping area in the location of 65 preventing gaps of non-reflective area being created when the annular rings or facets are tilted or angled from one another.

Further according to the invention, the adjustability and configuration of facets and annular segments of the reflector allow for adjustment of the shape of the light beams. The width of the beam both vertically and horizontally can variously be adjusted by moving the segments using manual control at the instrument or with motorized remote control actuators. This feature has long been desired in theaters. See for example, U.S. Pat. No. 2,853,599 to Kliegl. The implementation in this preferred embodiment provides adjustability both horizontally and vertically and achieves desired result without a lens which typically causes 6% to 7% loss of light through transmission loss.

Figure 8:
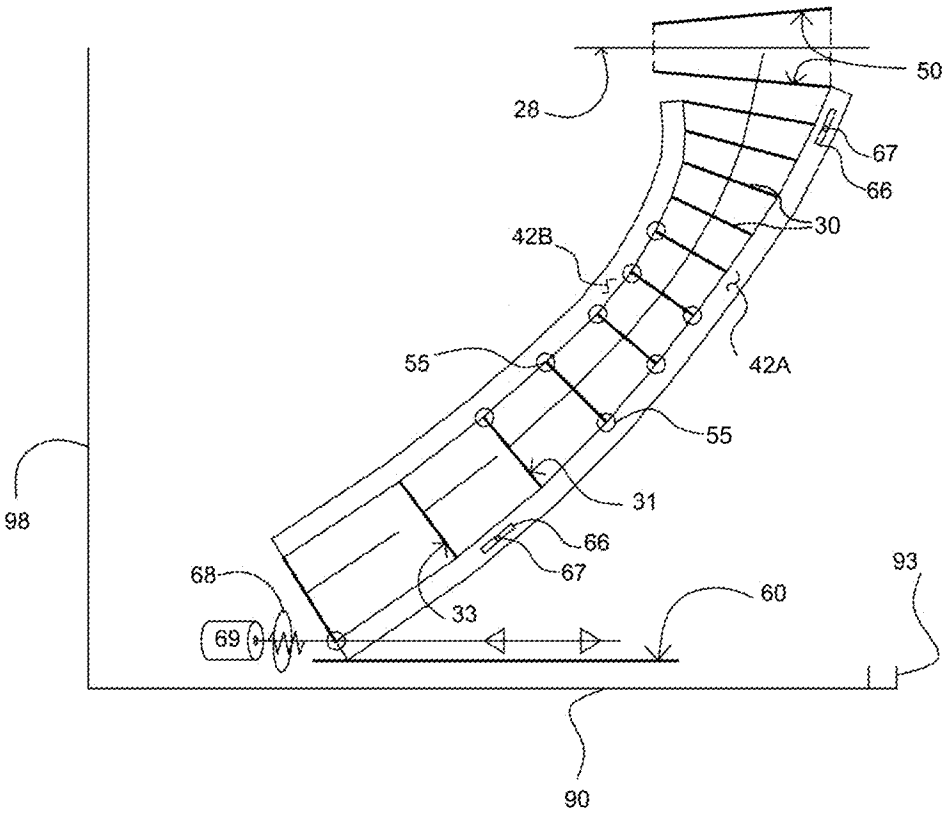
FIG. 8 is a side view of the support assembly and support arms of the apparatus of the invention.

FIG. 8 provides a detailed illustration of support arms 42. Two support arms 42A and 42B are shown with respect to one another, and the motion of the segmented rings 30. In the preferred embodiment, support arm 42 is fixedly connected to the outer perimeter frame of the lighting element assembly 60 of radial support 40. As one example, support arm 42 can slide via a slotted hole 66 on and is supported by a pin 67 protruding from the adjacent support arm that is also fixedly attached to lighting element assembly 60. The motion of support arm 42A with respect to support arm 42B will cause reflective surfaces 30 to tilt via joints 55 with respect to overall centerline 28. The sliding motion can be achieved via threaded rod 68 and crank for local control or remotely through use of an actuator 69.

Figure 9:
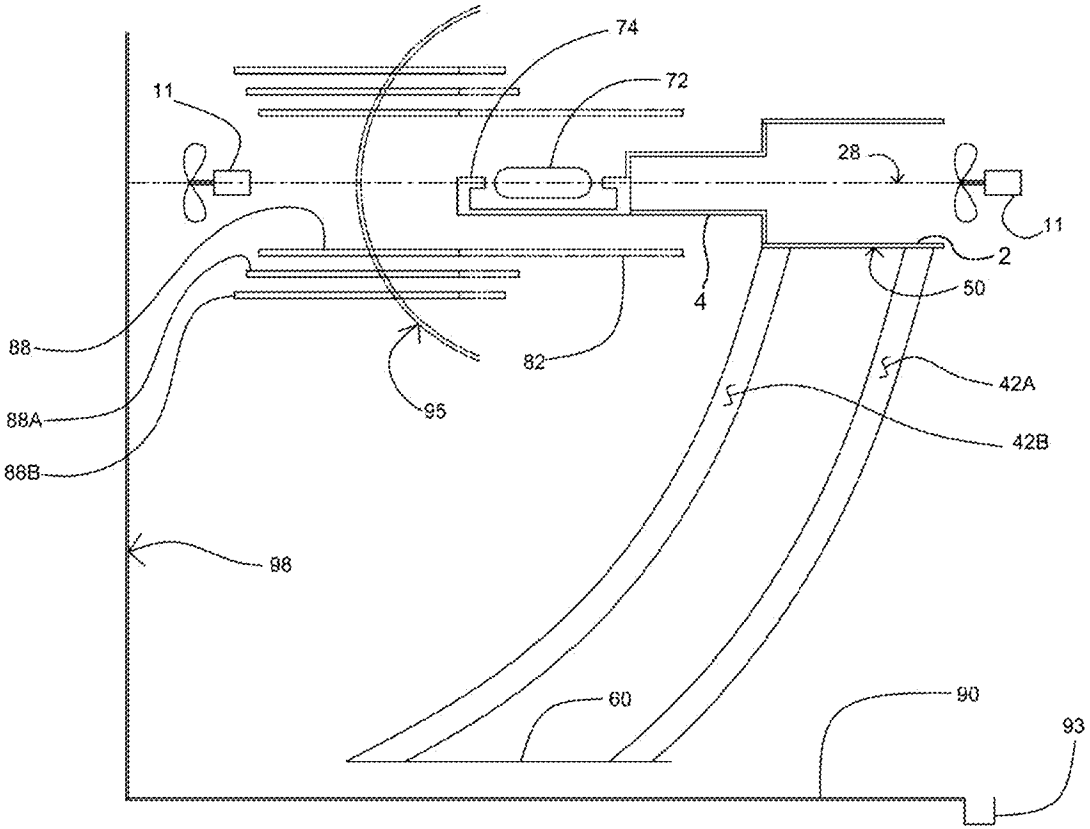
FIG. 9 shows a section view of a prior art lamp housing rear panel showing a circular rear reflector lamp and alternative color filters associated with a remote control actuator in conjunction with the segmented annular reflector of the invention.

FIG. 9 illustrates a manual or remotely controlled subtractive color mixing apparatus for use with the reflector system of FIG. 1. A prior art circular reflector 95, positioned so that it's radius point or focal point is near the midpoint of the light source 72 when viewed in cross-section, and the included circular angle of the reflective surface approximately matches that light remaining after all the light captured and redirected by the annular ring reflector system of FIG. 1 is directed towards the area to be illuminated. Reflector 95 is then able to capture light not sent forward directly by the reflector assembly 20 and redirect it through light source 72, after which it is be captured by the annular reflector system 20 and sent forward towards the area to be illuminated.

The apparatus of the invention can also employ color filters. Depending on the cone of light captured by the annular reflective system of the invention, and the cone of light blocked by the light socket mechanism 74 from the light source 72, a version of this reflector 95 with a hole in the center may also be deployable in one embodiment of the invention simultaneously in conjunction with several, three for example, or more tubular or polygonal color filters 88A and 88B. A circular or polygonal tube composed of dichroic color filter panels mounted in a matrix frame of other material or dichroic filter vacuum deposited directly on transparent substrate is typically used. Likewise, concentric filters 88A and 88B similarly constructed can also move horizontally independently of filter tube 88, allowing for varying amounts of any of the several colors to be used separately and simultaneously. The filters can be of varying diameters. Any color filters can be utilized with the system of the invention. Secondary colors of light [cyan, magenta, yellow] may be particularly useful so as to provide variable subtractive color mixing as employed in the three scroller color changer [See for example, U.S. Pat. No. 5,126,886 to Morpheus]. The deposition of dichroic color filter, often chosen because of its heat resistance, on the concentric colored tube 88, may be all of one density or fading in density down the length of the tube or around the tube perimeter to provide various color and pattern effects adjustably applied by variously sliding the filter tubes along centerline 28 of the reflector system or rotating the filter tubes. In one embodiment, the sliding mechanisms for the concentric filter tubes or polygons supporting or containing the color filter mediums can be mechanically supported from the rear panel 84 of the enclosure 86.

Figure 5:
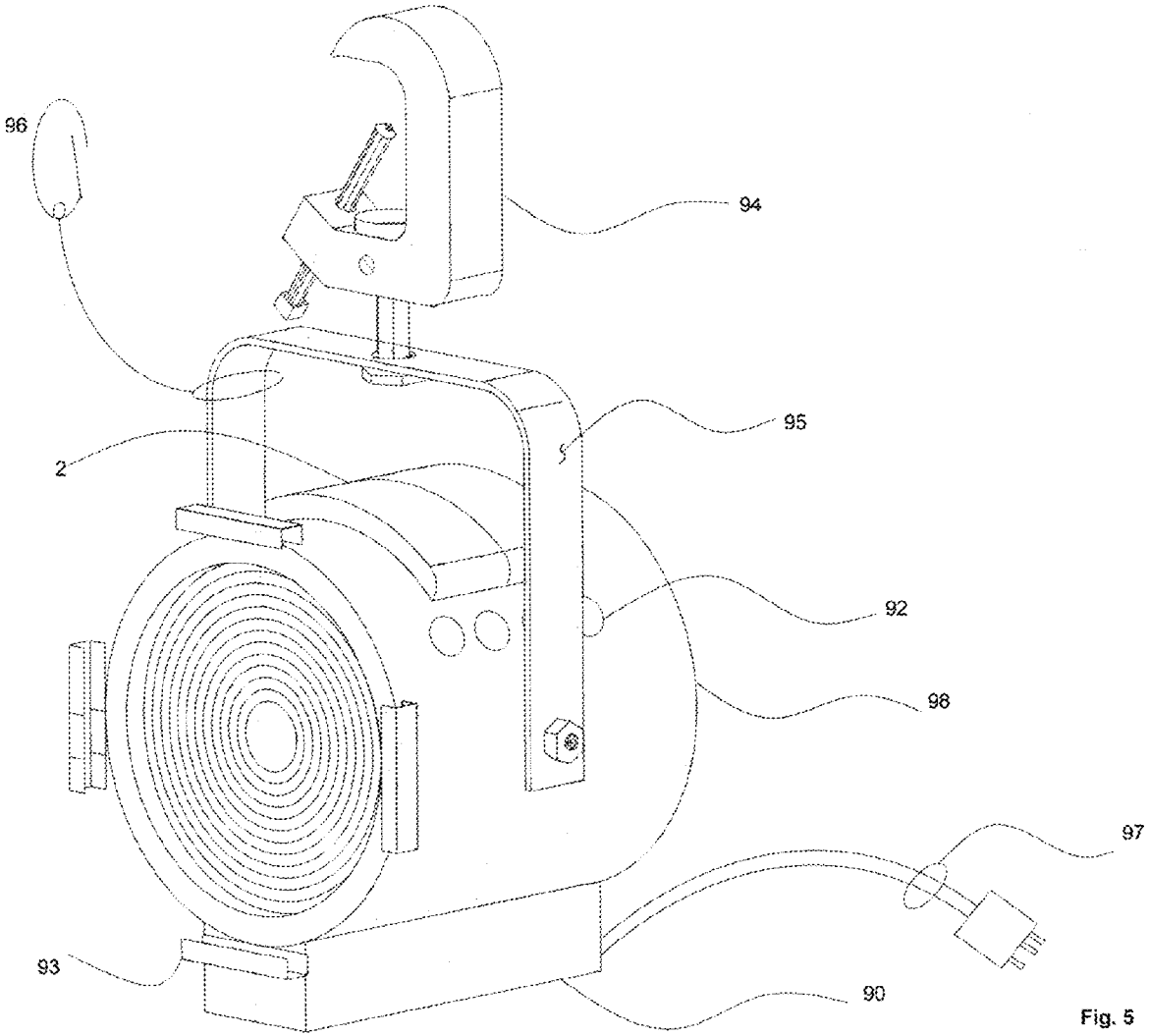
FIG. 5 shows a Fresnel spotlight exterior housing with mounting yoke and support clamp.
Figure 6:
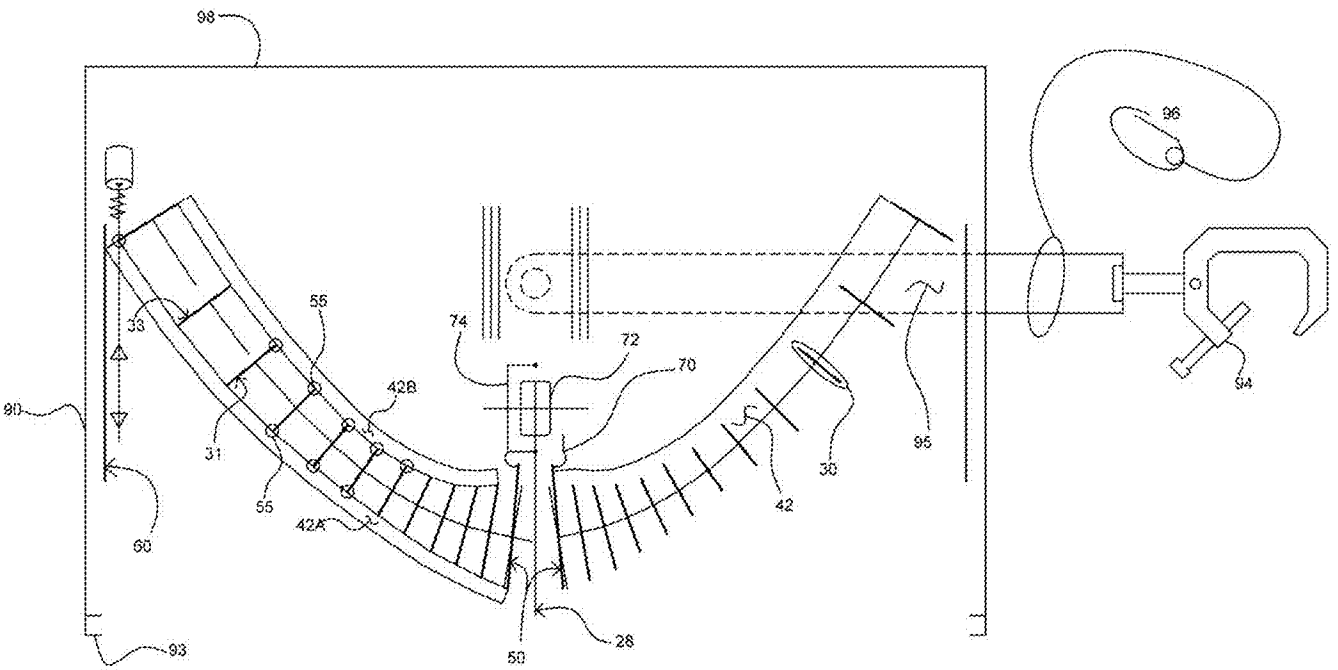
FIG. 6 is a sectional view of a Fresnel spotlight housing but having interior parts of the segmented annular ring reflector system of the invention from FIG. 1.

Referring to FIG. 5, illustrated is a Fresnel light 90 of the prior art. The can-shaped enclosure captures the light bounced from the reflector, lamp, or lens and limits the light from escaping from the enclosure interior. Baffled labyrinth openings 92 in the prior art metal enclosure allow heat to escape, but allow only minimal light to escape. To permit attachment of color media in front of the lighting instrument, a short trough 'U' shaped section holder 93 is positioned in three or four locations at the front of the instrument around the lens or output aperture. These holders can support glass, plastic or gelatin color filters. The entire lighting instrument is supported by conventional "lighting C clamp" 94. To allow panning in the horizontal plane [pivot at top center], and tilting of the light, in the vertical plane [pivot at the lower ends] a "U" shaped yoke mechanism 95 is provided for adjustment. For safety reasons, an additional support cable 96 is provided. To power the lamp inside, an electrical mains cable 97 is required. The back of the can housing 98, is often perforated using labyrinth holes 92 in its surface to relieve interior heat built-up. All of these elements may also be incorporated into the lighting apparatus of the invention.

A cooling fan or other cooling mechanism can be used together with the apparatus of the invention and/or be incorporated into the apparatus of the invention. The degree and nature of cooling required will be determined by the type of lamp employed in its wattage or heat dissipation.

It will be understood that the present disclosure is not limited to the embodiments disclosed herein as such embodiments may vary somewhat. It is also to be understood that the terminology employed herein is used for the purpose of describing particular embodiments only and is not intended to be limiting in scope and that limitations are only provided by the appended claims and equivalents thereof.

What is claimed is:

1. A reflector assembly comprising (a) a support assembly, (b) a support base and (c) two or more annular reflector segments secured to the support assembly, each of said two or more annular reflector segments defining an interior portion with an interior circumference and an exterior portion with an exterior circumference, wherein the interior circumference is greater than the exterior circumference; wherein the two or more annular reflector segments are configured for reflecting light from a light emitting element placed in proximity to the reflector assembly; and wherein the two or more annular reflector segments form an inner cone portion and an outer cone portion.

2. A reflector assembly comprising (a) a support assembly having at least one support arm and a support base, and (b) two or more annular reflector segments secured to the support assembly, each of said two or more annular reflector segments forming a successive annular reflector segment aperture and defining an interior portion with an interior circumference and an exterior portion with an exterior circumference, wherein the interior circumference is greater than the exterior circumference; wherein the two or more annular reflector segments are configured for reflecting light from a light emitting element placed in proximity to the reflector assembly and wherein a first annular reflector segment is closest to the support base and each successive annular reflector segment has an aperture that is less than the aperture of the preceding reflector segment.

3. The reflector assembly of claim 1 wherein at least one annular reflector segment comprises a reflective surface.

4. The reflector assembly of claim 1 wherein the support assembly is an encapsulation material.

5. The reflector assembly of claim 3 wherein the reflective surface is disposed toward the inner cone portion of the reflector assembly.

6. The reflector assembly of claim 3 wherein the reflective surface is disposed toward the outer cone portion of the reflector assembly.

7. A lighting apparatus comprising:

(a) a lighting assembly component having a light emitting element that is separably connected to a light socket, (b) a power supply component connected to the lighting assembly component, (c) a support assembly connected to a support base that houses a reflector assembly, and (d) the reflector assembly comprising two or more nested annular reflector segments fixedly secured to support arms of the support assembly, each of the two or more nested annular reflector segments defining an interior portion with an interior circumference and an exterior portion with an exterior circumference, wherein the interior circumference is greater than the exterior circumference; and the reflector assembly having an inner cone portion and an outer cone portion; wherein a first annular reflector segment is closest to the support base and each successive annular reflector segment has an aperture that is smaller than the aperture of the preceding annular reflector segment.

8. A lighting apparatus comprising:

(a) a lighting assembly component having a light emitting element that is separably connected to a light socket, (b) a power supply component connected to the lighting assembly component, (c) a support assembly having a support base and at least one support arm protruding from the support base, and (d) a reflector assembly comprising two or more nested annular reflector segments fixedly secured to the at least one support arm of the support assembly, each of said two or more nested annular reflector segments defining an interior portion with an interior circumference and an exterior portion with an exterior circumference wherein the interior circumference is greater than the exterior circumference; and the reflector assembly having an inner cone portion and an outer cone portion; wherein a first annular reflector segment is closest to the support base and each successive annular reflector segment has an aperture that is smaller than the aperture of the preceding annular reflector segment.

9. The lighting apparatus of claim 7 further comprising a control panel on the lighting apparatus.

10. The lighting apparatus of claim 7 further comprising a remote control.

11. The lighting apparatus of the claim 7 further comprising a color filter or colored light source.

* * * * *